US008940154B2

(12) United States Patent
Ding

(10) Patent No.: US 8,940,154 B2
(45) Date of Patent: Jan. 27, 2015

(54) SYSTEM AND PROCESS FOR PRODUCING HIGH QUALITY GASOLINE BY CATALYTIC HYDROCARBON RECOMBINATION

(76) Inventor: Ranfeng Ding, Beijing (CN)

( * ) Notice: Subject to any disclaimer, the term of this patent is extended or adjusted under 35 U.S.C. 154(b) by 1302 days.

(21) Appl. No.: 12/682,031

(22) PCT Filed: Nov. 6, 2008

(86) PCT No.: PCT/CN2008/072965
§ 371 (c)(1),
(2), (4) Date: Apr. 7, 2010

(87) PCT Pub. No.: WO2009/067893
PCT Pub. Date: Jun. 4, 2009

(65) Prior Publication Data

US 2010/0236981 A1 Sep. 23, 2010

(30) Foreign Application Priority Data

Nov. 9, 2007 (CN) ..... 2007 1 0169944
Nov. 9, 2007 (CN) ..... 2007 1 0169945
Nov. 9, 2007 (CN) ..... 2007 1 0169946

(51) Int. Cl.
*C10G 45/44* (2006.01)
*C10G 21/00* (2006.01)

(Continued)

(52) U.S. Cl.
CPC ..... *C10G 21/00* (2013.01); *C10G 45/38* (2013.01); *C10G 45/50* (2013.01); *C10G 65/16* (2013.01);

(Continued)

(58) Field of Classification Search
CPC ..... C10G 21/00; C10G 45/38; C10G 45/50; C10G 65/16; C10G 67/00; C10G 2300/301; C10G 2400/02; C10G 2300/104; C10G 2300/1044; C10G 67/04; C10L 1/06
USPC ..... 208/49, 80, 106, 107, 108, 113, 134, 208/142, 143, 308, 311, 313, 315, 317, 208/354; 196/46, 46.1, 155; 202/81, 82, 202/158; 585/899
See application file for complete search history.

(56) References Cited

U.S. PATENT DOCUMENTS 6,620,311 B2 9/2003 Morel et al. ..... 208/57
2002/0029997 A1 * 3/2002 Rappas et al. ..... 208/240

(Continued)

FOREIGN PATENT DOCUMENTS

CN 1356375 7/2002
CN 200310103540 11/2003

(Continued)

OTHER PUBLICATIONS

International Search Report of International Application No. PCT/CN2008/072965, dated Feb. 19, 2009.

*Primary Examiner* — Shogo Sasaki
(74) *Attorney, Agent, or Firm* — J.C. Patents

(57) ABSTRACT

A system and process for the preparation of high quality gasoline through recombination of catalytic hydrocarbon includes fractionator and extractor. The upper part of the fractionator is equipped with light petrol pipeline, the lower part of the fractionator is equipped with heavy petrol pipeline, the middle part of the fractionator is equipped with medium petrol pipeline. The medium petrol pipeline is connected with a medium petrol extractor, the upper part of the medium petrol extractor is connected with the medium petrol raffinate oil hydrogenation unit through the pipeline, the lower part of the medium petrol extractor is connected with the medium petrol aromatic hydrocarbon hydrogenation unit through the pipeline. The medium petrol aromatic hydrocarbon hydrogenation unit is then connected with the light petrol pipeline in the upper part of the fractionator through the pipeline, the lower part of the heavy petrol extractor is connected with the medium petrol aromatic hydrocarbon hydrogenation unit through the pipeline, the upper part of the heavy petrol extractor is connected with the medium petrol raffinate oil hydrogenation unit through the pipeline.

3 Claims, 4 Drawing Sheets

(51) Int. Cl.

| | |
|---|---|
| ***C10G 45/38*** | (2006.01) |
| ***C10G 45/50*** | (2006.01) |
| ***C10G 65/16*** | (2006.01) |
| ***C10G 67/00*** | (2006.01) |
| ***C10G 67/04*** | (2006.01) |
| ***C10L 1/06*** | (2006.01) |

(52) U.S. Cl.

CPC ..... *C10G 67/00* (2013.01); *C10G 67/04* (2013.01); *C10L 1/06* (2013.01); *C10G 2400/02* (2013.01); *C10G 2300/104* (2013.01); *C10G 2300/1044* (2013.01); *C10G 2300/301* (2013.01)

USPC ..... 208/80; 585/899; 202/81; 202/82; 202/158; 196/46; 196/46.1; 196/155; 208/49; 208/106; 208/107; 208/108; 208/113; 208/134; 208/142; 208/143; 208/308; 208/311; 208/313; 208/315; 208/317; 208/354

(56) References Cited

U.S. PATENT DOCUMENTS

| | | | | |
|---|---|---|---|---|
| 2002/0153280 | A1* | 10/2002 | Didillon et al. | 208/57 |
| 2003/0111388 | A1* | 6/2003 | Zhang et al. | 208/113 |
| 2007/0068849 | A1* | 3/2007 | Araki et al. | 208/16 |
| 2007/0175800 | A1* | 8/2007 | Ding | 208/313 |
| 2007/0246399 | A1* | 10/2007 | Picard et al. | 208/78 |

FOREIGN PATENT DOCUMENTS

| | | |
|---|---|---|
| CN | 200310103541 | 11/2003 |
| CN | 1470607 | 1/2004 |
| CN | 1613976 | 5/2005 |
| CN | 03148181 | 1/2007 |
| CN | 100425675 | 10/2008 |
| CN | 201144231 | 11/2008 |
| CN | 201154954 | 11/2008 |
| CN | 201158633 | 12/2008 |

* cited by examiner

SYSTEM AND PROCESS FOR PRODUCING HIGH QUALITY GASOLINE BY CATALYTIC HYDROCARBON RECOMBINATION

FIELD OF THE INVENTION

This invention relates to a system for the preparation of a high quality gasoline through the recombination of catalytic hydrocarbon and its process.

DESCRIPTION OF THE PRIOR ART

Catalytic cracking, catalytic schizolysis and heavy oil catalytic schizolysis technology is the key technology of the oil refining, catalytic schizolysis is classified into the catalytic schizolysis of wax oil and the catalytic schizolysis of heavy oil. The generated oils produced from these processes are collectively called catalytic hydrocarbons. Through the processing & handling, generally fractionation with fractionator, the obtained catalytic hydrocarbons can be fractionated into the products such as dry petroleum gas, liquefied petroleum gas, gasoline, diesel oil and heavy oil etc. Among them, the gasoline and diesel oil occupy above 70% of the supply volume of the gasoline and diesel oil in the market.

As the environmental protection requirements become more and more strict, the standard of gasoline & diesel oil will be increased continuously. The current processing method wherein the catalytic hydrocarbons go through the fractionator has the following shortcomings: the first is that the quality of the produced gasoline and diesel oil should be improved, the alkenes content is too high, octane value (RON) is too low, the cetane number of the diesel oil is too low, the stability does not conform to the requirements. The second is that the above processing method can not produce multiple grades of gasoline simultaneously, in addition, there is only one product type. The third is that the proportion between produced gasoline and diesel oil does not conform to the market need, the diesel oil can not satisfy the need, whereas the gasoline is in oversupply status.

In order to solve the above problem, there is a Chinese patent with patent No03148181.7 namely "treatment method of catalyzing the hydrocarbon recombination" and the Chinese patents with patent No200310103541.9 and 200310103540.4 have given publicity to the improved patents, however, the methods of reducing sulfur and olefin have not been touched upon in these publicized patents.

The current GB 17930 gasoline standard requires that the sulfur content is below 0.05% (wt), the olefin content is below 35% (v) and the benzene content is below 2.5% (v). Most of the refineries can assure the quality of the gasoline. However, the National Gasoline Standard III that will be implemented in 2010 requires the following: the sulfur content is below 0.015% (wt), the olefin content is below 30% (v) and the benzene content is below 1% (v). For most of the refineries, they must be confronted with the requirements of higher standard, i.e., the National Gasoline Standard IV: the sulfur content is below 0.005% (wt), the olefin content is below 25% (v) or even lower. Gasoline quality solution must consider the transition from National Gasoline Standard III to National Gasoline Standard IV. The better planning is to follow National Gasoline Standard IV in single step.

Since the proportions of blended components in the gasoline products of our country differ greatly with those of the developed countries, the catalytic cracking gasoline (hereafter called catalytic gasoline) occupies a high proportion while reformed gasoline and gasoline alkyl ate only occupies a little proportion. Furthermore, this condition will exist for a long time. Therefore, the method of reducing sulfur and olefin mainly touches upon the problem of catalyzed gasoline.

It is generally acknowledged that 5-10% of the general sulfur in the catalytic cracking material will enter the gasoline fraction. According to the characteristics of the refineries in our country that catalytic material hydrogenation purification capability is low, secondary processing catalytic cracking capability is high and there is residual oil coking, the sulfur content of the catalytic gasoline in the refinery processing the crude oil with low sulfur content (sulfur content 0.3%) is about 200 ppm, if the crude oil with sulfur content of 0.8%, the sulfur content of the catalytic gasoline is about 900 ppm. Therefore, the difficult point in the upgrade of gasoline quality has changed from the problem of olefin to the problem of sulfur. It is impossible to radically solve the problem of sulfur through the improvement of catalytic cracking process or catalyst. The catalytic cracking material hydrogenation and desulfurization cannot be applied in large scale due to big investment, high operation cost and current condition in the refineries. Furthermore, it is inapplicable to the refineries processing rude oil with low sulfur content. In the meantime, the catalytic cracking equipment excessively reduces the olefin; therefore, it will aggravate the loss of benzoline and the octane number (RON) of the gasoline.

Therefore, it is a technical problem that how to provide a system for blended gasoline having low sulfur content, low olefin content and high octane number (RON) with low cost.

SUMMARY OF THE INVENTION

One of the object of the invention is to provide, a gasoline catalytic hydrocarbon recombination system having low sulfur content, low olefin content and high octane number (RON) with low cost is provided.

In order to realize the above purpose, this invention adopts the following technical resolution:

One Technical Resolution as Follows:

A system for the preparation of a high quality gasoline through the recombination of catalytic hydrocarbon, including fractionator and extractor, wherein the upper part of the said fractionator is equipped with light petrol pipeline, the lower part of the above fractionator is equipped with heavy petrol pipeline, the middle part of the said fractionator is equipped with medium petrol pipeline, the said medium petrol pipeline is connected with the medium petrol extractor, the upper part of the medium petrol extractor is connected with the medium petrol raffinate oil hydrogenation unit through the pipeline, the lower part of the said medium petrol extractor is connected with the medium petrol aromatic hydrocarbon hydrogenation unit through the pipeline, the said medium petrol aromatic hydrocarbon hydrogenation unit is then connected with the light petrol pipeline in the upper part of the said fractionator through the pipeline, the lower part of the said heavy petrol extractor is connected with the said medium petrol aromatic hydrocarbon hydrogenation unit through the pipeline, the upper part of the heavy petrol extractor is connected with the said medium petrol raffinate oil hydrogenation unit through the pipeline.

Another Technical Resolution as Follows:

A system for the preparation of a high quality gasoline through the recombination of catalytic hydrocarbon, including fractionator and extractor, wherein: the upper part of the said fractionator is connected with light petrol hydrogenation unit through the pipeline, the lower part of the said fractionator is equipped with heavy petrol pipeline, the middle part of the said fractionator is equipped with medium petrol pipeline, the said medium petrol pipeline is connected with the medium petrol extractor, the upper part of the medium petrol extractor is connected with the medium petrol raffinate oil hydrogenation unit through the pipeline, the lower part of the said medium petrol extractor is connected with the medium petrol aromatic hydrocarbon hydrogenation unit through the pipeline, then it is connected with the light petrol pipeline in upper part of the said fractionator behind the light petrol hydrogenation unit through the pipeline, the lower part of the said heavy petrol extractor is connected with the said medium petrol aromatic hydrocarbon hydrogenation unit through the pipeline, the upper part of the heavy petrol extractor is connected with the said medium petrol raffinate oil hydrogenation unit through the pipeline, or it will directly produces low solidification point diesel product.

A preferred system, wherein the upper part of the fractionator is also equipped with pipeline to round the light petrol hydrogenation unit and directly extract the light petrol.

Another object of the invention is to provide a process for the preparation of a gasoline with low sulfur content and low olefin content through the catalytic hydrocarbon recombination.

In order to realize the above purpose, this invention adopts the following technical resolution:

One Technical Resolution as Follows:

A process for the preparation of a high quality gasoline through the recombination of catalytic hydrocarbon comprising: put the stabilized gasoline into the fractionator to carry out the distilling and fractionize into the light petrol, medium petrol and heavy petrol. The above light petrol is distilled through the upper part of the fractionator, the said medium petrol enters the medium petrol extractor through the pipeline to carry out extraction separation and separate into aromatic hydrocarbon and raffinate oil, the said aromatic hydrocarbon is hydrogenated through the aromatic hydrocarbon hydrogenation unit, then it is blended and used with the light petrol distilled from the upper part of the fractionator, after the medium petrol raffinate oil is hydrogenated through the raffinate oil hydrogenation unit, it is directly used as ethylene material; the said heavy petrol enters heavy petrol extractor through the pipeline to carry out extraction separation and separate into aromatic hydrocarbon and raffinate oil, the said aromatic hydrocarbon obtained from the extraction of the heavy petrol is blended with the aromatic hydrocarbon obtained from the extraction of the medium petrol, then it is hydrogenated through the aromatic hydrocarbon unit, subsequently it is blended with the light petrol distilled from the upper part of the fractionator; the raffinate oil obtained from the extraction of the said heavy petrol is blended with the raffinate oil obtained from the extraction of the said medium petrol, then it is hydrogenated through the said raffinate oil hydrocarbon unit and it is regarded as the ethylene material.

A preferred process, wherein the tower top temperature of the said fractionator is 65~74° C., the tower bottom temperature is 180~195° C., the tower top pressure of the said fractionator is 0.11~0.28 MPa (absolute pressure), the tower bottom pressure is 0.12~0.30 MPa (absolute pressure), the distillation range of the above light petrol is controlled to 30° C.~65° C., the said medium petrol is controlled to 65° C.~160° C. and the distillation range of the said heavy gasoline is controlled to 160° C.~205° C.

A preferred process, wherein the tower top temperature of the said fractionator is 69° C., the tower bottom temperature is 190° C., the tower top pressure of the said fractionator is 0.2 MPa (absolute pressure), the tower bottom pressure is 0.25 MPa (absolute pressure), the distillation range of the said light petrol is controlled to 30° C.~90° C., the said medium petrol is controlled to 90° C.~160° C. and the distillation range of the said heavy gasoline is controlled to 160° C.~205° C.

A preferred process, wherein the catalyst of the said raffinate oil hydrogenation unit is selective hydrogenation catalyst GHT-20, the volume airspeed ratio of the said raffinate oil hydrogenation unit is 2~4, hydrogen/oil volume ratio is 250~350, the operation temperature is 285~325° C., the operation pressure is 1.5~2.5 MPa (absolute pressure).

A preferred process, wherein the physical and chemical characteristics of the catalyst of the said raffinate oil hydrogenation unit, i.e., selective hydrogenation catalyst GHT-20 are in the following table:

| Name of the index | Unit | GHT-20 |
|---|---|---|
| Appearance | | Grey three-leaf type |
| Specification | mm | Φ1.5-2.0 |
| Intensity | N/cm | 170 |
| Bulk density | g/ml | 0.70 |
| Specific surface | $m^2/g$ | 180 |
| Pore volume | ml/g | 0.5-0.6 |
| $WO_3$ | m % | 6.6 |
| NiO | m % | 2.1 |
| $C_0O$ | m % | 0.16 |

A preferred process, wherein the catalyst of the said aromatic hydrocarbon hydrogenation unit is full hydrogenation catalyst, GHT-22, the volume airspeed ratio of the said heavy gasoline hydrogenation unit is 2~4, hydrogen/oil volume ratio is 250~350, the operation temperature is 280~325° C., the operation pressure is 1.5~2.5 MPa (absolute pressure).

A preferred process, wherein the physical and chemical characteristics of the said full hydrogenation catalyst GHT-22 are in the following table:

| Name of the index | Unit | GHT-22 |
|---|---|---|
| Appearance | | Grey three-leaf type |
| Specification | mm | Φ1.5-2.0 |
| Intensity | N/cm | 180 |
| Bulk density | g/ml | 0.73 |
| Specific surface | $m^2/g$ | 180 |
| Pore volume | ml/g | 0.5-0.6 |
| $WO_3$ | m % | 15 |
| NiO | m % | 1.7 |
| $C_0O$ | m % | 0.15 |
| $Na_2O$ | m % | <0.09 |
| $Fe_2O_3$ | m % | <0.06 |
| $SiO_2$ | m % | <0.60 |
| Carrier | m % | 82.4 |

Another Technical Resolution as Follows:

A process for the preparation of a high quality gasoline through the recombination of catalytic hydrocarbon comprising: the stabilized gasoline is put into the fractionator to carry out the distilling and fractionize into the light petrol, medium petrol and heavy petrol, the said light petrol is distilled through the upper part of the fractionator after being hydrogenated in the light petrol hydrogenation unit, the said medium petrol enters the medium petrol extractor through the pipeline to carry out extraction separation and separate into aromatic hydrocarbon and raffinate oil, the said aromatic hydrocarbon is hydrogenated through the aromatic hydrocarbon hydrogenation unit, then it is blended and used with the light petrol distilled from the upper part of the fractionator, after the medium petrol raffinate oil is hydrogenated through the raffinate oil hydrogenation unit, it is directly used as ethylene material; the said heavy petrol enters heavy petrol extractor through the pipeline to carry out extraction separation and separate into aromatic hydrocarbon and raffinate oil, the said aromatic hydrocarbon obtained from the extraction of the heavy petrol is blended with the aromatic hydrocarbon obtained from the extraction of the medium petrol, then it is hydrogenated through the aromatic hydrocarbon unit, subsequently it is blended with the light petrol distilled from the upper part of the fractionator, the raffinate oil obtained from the extraction of the said heavy petrol is blended with the raffinate oil obtained from the extraction of the said medium petrol, then it is hydrogenated through the said raffinate oil hydrocarbon unit and it is extracted as the ethylene material.

A preferred process, wherein as for the light petrol distilled from the upper part of the fractionator, there is 50% weight that rounds light petrol hydrogenation unit and it is directly extracted out.

A preferred process, wherein the tower top temperature of the said fractionator is 67~68° C., the tower bottom temperature is 186~188° C., the tower top pressure of the said fractionator is 0.2 MPa (absolute pressure), the tower bottom pressure is 0.25 MPa (absolute pressure), the distillation range of the said light petrol is controlled to 30° C.~65° C., the said medium petrol is controlled to 65° C.~160° C. and the distillation range of the said heavy gasoline is controlled to 160° C.~205° C.

A preferred process, wherein the tower top temperature of the said fractionator is 67~68° C., the tower bottom temperature is 186~188° C., the tower top pressure of the said fractionator is 0.2 MPa (absolute pressure), the tower bottom pressure is 0.25 MPa (absolute pressure), the distillation range of the said light petrol is controlled to 30° C.~80° C., the said medium petrol is controlled to 80° C.~160° C. and the distillation range of the said heavy gasoline is controlled to 160° C.~205° C.

A preferred process, wherein the catalyst of the said light petrol hydrogenation unit is selective hydrogenation catalyst GHT-20, the volume airspeed ratio of the said light petrol hydrogenation unit is 2, hydrogen/oil volume ratio is 150, the operation temperature is 230° C., the operation pressure is 1.0 MPa (absolute pressure).

A preferred process, wherein the physical and chemical characteristics of the catalyst of the said selective hydrogenation catalyst, i.e., GHT-20, are seen in the following table:

| Name of the index | Unit | GHT-20 |
|---|---|---|
| Appearance | | Grey three-leaf type |
| Specification | mm | Φ1.5-2.0 |
| Intensity | N/cm | 170 |
| Bulk density | g/ml | 0.70 |
| Specific surface | $m^2/g$ | 180 |
| Pore volume | ml/g | 0.5-0.6 |
| $WO_3$ | m % | 6.6 |
| NiO | m % | 2.1 |
| $C_0O$ | m % | 0.16 |

A preferred process, wherein the catalyst of the said raffinate oil hydrogenation unit is selective hydrogenation catalyst GHT-20, the volume airspeed ratio of the said raffinate oil hydrogenation unit is 2~4, hydrogen/oil volume ratio is 250~350, the operation temperature is 285~325° C., the operation pressure is 1.5~2.5 MPa (absolute pressure).

A preferred process, wherein the catalyst of the said aromatic hydrocarbon hydrogenation unit is full hydrogenation catalyst, GHT-22, the volume airspeed ratio of the said heavy gasoline hydrogenation unit is 2~4, hydrogen/oil volume ratio is 250~350, the operation temperature is 285~325° C., the operation pressure is 1.5~2.5 MPa (absolute pressure).

A preferred process, wherein the physical and chemical characteristics of the said full hydrogenation catalyst GHT-22 are seen in the following table:

| Name of the index | Unit | GHT-22 |
|---|---|---|
| Appearance | | Grey three-leaf type |
| Specification | mm | Φ1.5-2.0 |
| Intensity | N/cm | ≥180 |
| Bulk density | g/ml | ≥0.73 |
| Specific surface | $m^2/g$ | ≥180 |
| Pore volume | ml/g | 0.5-0.6 |
| $WO_3$ | m % | ≥15 |
| NiO | m % | ≥1.7 |
| $C_0O$ | m % | ≥0.15 |
| $Na_2O$ | m % | <0.09 |
| $Fe_2O_3$ | m % | <0.06 |
| $SiO_2$ | m % | <0.60 |
| Carrier | m % | 82.4 |

The fractionator used in this invention is the fractionator disclosed in the China patent 03148181.7 namely "catalytic hydrocarbon recombination treatment method". The said extractor uses the extractor disclosed in the China patents 200310103541.9 and 200310103540.4, including solvent recycling and water rinsing system.

The hydrogenation unit used in this invention is the current hydrogenation unit, including heating furnace, heat exchanger, high-pressure separator, air condenser and water condenser etc.

BRIEF DESCRIPTION OF THE DRAWING

In the following, we will further explain this invention through attached drawings and embodiments, but this does not mean the limitation to this invention.

DETAILED DESCRIPTION OF THE INVENTION

Embodiment 1

Figure 1:
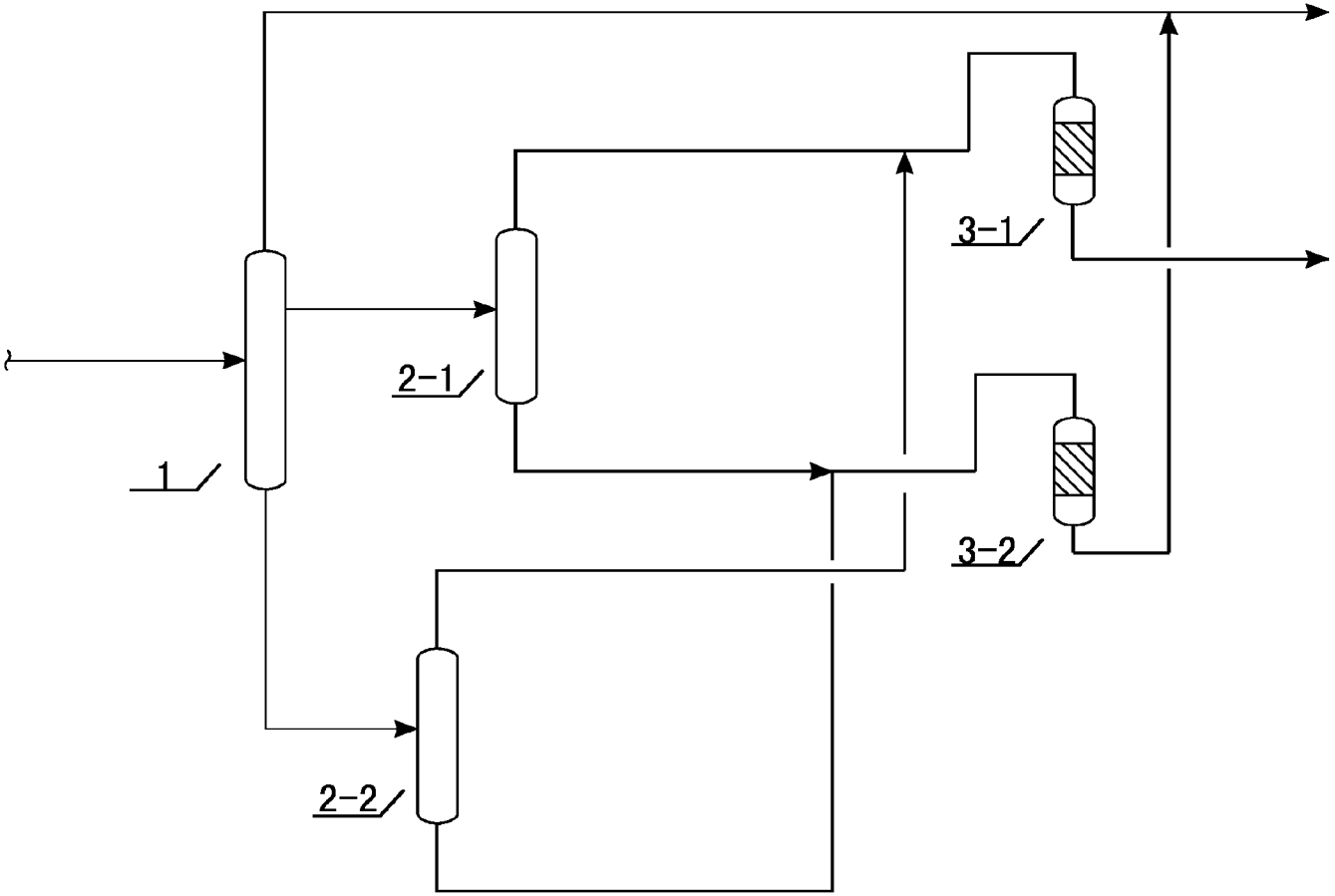
FIG. 1 is the schematic flow sheet of embodiment 1.

See FIG. 1, it is the schematic flow sheet of this embodiment. The gasoline is fractionated at fractionator 1 with the flow rate of 100,000 ton/year to the stabilized gasoline (catalytic gasoline) with low sulfur content whose distilling range is 30-205° C., sulfur content is 100 ppm, mercaptan content is 5 ppm, olefin content is 30% (v), diolefin content is 0.1% (v), aromatic hydrocarbon content is 15% (v), octane number (RON) is 89, density is 728 kg/m3, the tower top temperature of distilling tower 1 is 69° C., the tower bottom temperature is 192° C., tower top pressure is 0.2 MPa (absolute pressure), tower bottom pressure is 0.25 MPa (absolute pressure), light petrol, medium petrol and heavy petrol can be separately obtained. The above light petrol (distilling range 30-90° C.) is vaporized through the upper of distilling tower 1, the total vaporization volume is 43,000 tons/year. The above medium petrol (distilling range 90-160° C.) is conveyed into the medium petrol extractor 2-1 to carry out extraction separation with the flow rate of 25000 tons/year and separate into aromatic hydrocarbon and raffinate oil. The solvent used in the above medium petrol extractor 2-1 is N-methyl-morph line, the extracting temperature is 95° C., solvent ratio (solvent/ inlet material) is 2.5 (mass), the rinsing ratio of the raffinate oil is 0.2 (mass), the solvent recovery temperature is 155° C., the solvent recovery pressure is 0.13 MPa (absolute pressure), the above aromatic hydrocarbon passes the pipeline with the flow rate of 5000 tons/year into the aromatic hydrocarbon hydrogenation unit to carry out hydrogenation, then it passes the pipeline to be blended with the hydrogenated light petrol, the above raffinate oil passes the raffinate oil hydrogenation unit 3-1 with the flow rate of 20000 tons/year to carry out hydrogenation, then it is treated as ethylene material, The catalyst of the above raffinate oil hydrogenation unit 3-1 is selective hydrogenation catalyst GHT-20. The volume airspeed ratio of the above raffinate oil hydrogenation unit 3-1 is 2, hydrogen/oil volume ratio is 250, the operation temperature is 285° C., the operation pressure is 1.5 MPa (absolute pressure).

The above heavy petrol (distilling range 160-205° C.) enters the heavy petrol extractor 2-2 to carry out extraction separation with the flow rate of 32000 tons/year and aromatic hydrocarbon and raffinate oil are separated out.

The solvent used in the above extractor 2-2 is N-methylmorpholine, the extraction temperature is 115° C., the ratio of solvent (solvent/feed material) is 3.5 (mass), the rinsing ratio of the raffinate oil is 0.2 (mass), the recovered temperature of the solvent is 151° C., the recovered pressure of the solvent is 0.112 MPa (absolute pressure), the above aromatic hydrocarbon as the product of the heavy petrol abstraction is blended with the aromatic hydrocarbon as the product of the medium petrol abstraction with the flow rate of 11000 tons/year, then it enters the aromatic hydrocarbon hydrogenation unit 3-2 to carry out hydrogenation, subsequently it is mixed with the above light petrol.

The catalyst of the above aromatic hydrocarbon hydrogenation unit 3-2 is full hydrogenation catalyst GHT-22, The volume airspeed ratio of the above aromatic hydrocarbon hydrogenation unit 3-2 is 2, hydrogen/oil volume ratio is 250, the operation temperature is 285° C., the operation pressure is 1.5 MPa (absolute pressure). The raffinate oil as the product of the heavy petrol abstraction is blended with the raffinate oil as the product of the medium petrol abstraction with the flow rate of 21000 tons/year, then it is hydrogenated in the raffinate oil hydrogenation unit, finally it is extracted as fine quality ethylene material.

The distilling range of the obtained blended petrol is 30-205° C., the sulfur content is 19.25 ppm, the mercaptan content is 3.95 ppm, the olefin content is 22.36% (v), the diolefin content is 0.08% (v), the aromatic hydrocarbon content is 23.78% (v), the octane number (RON) is 93.56, the density is 712.52 kg/m3, the oil output is 59000 tons/year.

The distilling range of the obtained fine quality ethylene material is 65-160° C., the sulfur content is 0.5 ppm, the mercaptan content is less than 1 ppm, the olefin content is less than 0.1% (v), the diolefin content is less than 0.01% (v), the aromatic hydrocarbon content is 3.0% (v), the octane number (RON) is 74.24, the density is 751.50 kg/m3, the oil output is 41000 tons/year.

The physical and chemical characteristics of the above selective hydrogenation catalyst GHT-20 are seen in the following table:

| Name of the index | Unit | GHT-20 |
|---|---|---|
| Appearance | | Grey three-leaf type |
| Specification | mm | Φ1.7 |
| Intensity | N/cm | 170 |
| Bulk density | g/ml | 0.70 |

-continued

| Name of the index | Unit | GHT-20 |
|---|---|---|
| Specific surface | $m^2/g$ | 180 |
| Pore volume | ml/g | 0.55 |
| $WO_3$ | m % | 6.6 |
| NiO | m % | 2.1 |
| $C_0O$ | m % | 0.16 |

The physical and chemical characteristics of the above full hydrogenation catalyst GHT-22 are seen in the following table:

| Name of the index | Unit | GHT-22 |
|---|---|---|
| Appearance | | Grey three-leaf type |
| Specification | mm | Φ1.7 |
| Intensity | N/cm | 180 |
| Bulk density | g/ml | 0.73 |
| Specific surface | $m^2/g$ | 180 |
| Pore volume | ml/g | 0.57 |
| $WO_3$ | m % | 15 |
| NiO | m % | 1.7 |
| $C_0O$ | m % | 0.15 |
| $Na_2O$ | m % | <0.09 |
| $Fe_2O_3$ | m % | <0.06 |
| $SiO_2$ | m % | <0.60 |
| Carrier | m % | 82.4 |

The measuring methods used in this invention are as follows (same below):

1. Distilling range: GB/T6536-1997 petroleum products—determination of distillation
2. Sulfur content: SH/T0689-2000 light hydrocarbon & engine fuel and other petroleum products-determination of total sulfur content (ultra-luminescence method)
3. Mercaptan sulfur: GB/T1792-1988 Distillate fuels—Determination of mercaptan sulphur—Potentiometric titration method
4. Olefin: GB/T11132-2002 Liquid petroleum products—Determination of hydrocarbon types-Fluorescent indicator absorption method
5. Aromatic hydrocarbon: GB/T11132-2002 Liquid petroleum products—Determination of hydrocarbon types-Fluorescent indicator absorption method
6. Octane number: GB/T5487 gasoline-testing methods for octane number-research method
7. Density: GB/T1884-2000, method for laboratory measurement of crude oil and liquid petroleum products (densitometer method)
8. Measurement of the diolefin: titration method
9. Hydrogenation catalyst analysis method:

| Chemical component | Analytical procedure | Applied petrochemical industry standard |
|---|---|---|
| NiO | Colorimetric analysis | SH/T0346-1992 |
| CoO | Colorimetric analysis | SH/T0345-1992 |
| $WO_3$ | Colorimetric analysis | |
| Physical characteristics | Analytical procedure | Applied instrument |
| Surface area | Low temperature nitrogen adsorption | 2400 model sorption analyzer |
| Pore volume | Mercury intrusion method | Auto Pore II 9200 |

-continued

| Chemical component | Analytical procedure | Applied petrochemical industry standard |
|---|---|---|
| Intensity | Cold Crushing Strength measurement method | DL II type intelligent granular intensity measuring gauge |
| Bulk density | Weighing method | |

Embodiment 2

See FIG. 1, it is the schematic flow sheet of this embodiment. The gasoline is fractionated at fractionator 1 with the flow rate of 100,000 ton/year to the stabilized gasoline (catalytic gasoline) with high sulfur content whose distilling range is 30-205° C., sulfur content is 100 ppm, mercaptan content is 5 ppm, olefin content is 30% (v), diolefin content is 0.1% (v), aromatic hydrocarbon content is 15% (v), octane number (RON) is 89, density is 728 kg/m$^3$, the tower top temperature of distilling tower 1 is 69° C., the tower bottom temperature is 190° C., tower top pressure is 0.2 MPa (absolute pressure), tower bottom pressure is 0.25 MPa (absolute pressure), light petrol, medium petrol and heavy petrol can be separately obtained. The above light petrol (distilling range 30-65° C.) is vaporized through the upper of distilling tower 1, the total vaporization volume is 43,000 tons/year. The above medium petrol (distilling range 65-160° C.) is conveyed into the medium petrol extractor 2-1 with the flow rate of 25,000 tons/year to carry out extraction separation and separate into aromatic hydrocarbon and raffinate oil. The solvent used in the above medium petrol extractor 2-1 is N-methyl-morpholine, the extracting temperature is 95° C., solvent ratio (solvent/inlet material) is 2.5 (mass), the rinsing ratio of the raffinate oil is 0.2 (mass), the solvent recovery temperature is 155° C., the solvent recovery pressure is 0.13 MPa (absolute pressure), the aromatic hydrocarbon as the product of the extraction of the above medium petrol passes the pipeline with the flow rate of 5000 tons/year into the aromatic hydrocarbon hydrogenation unit 3-2 to carry out hydrogenation, then it passes the pipeline to be blended with the hydrogenated light petrol in the upper part of the distilling tower 1, the above raffinate oil as the product of the extraction of the above medium petrol passes the raffinate oil hydrogenation unit 3-1 with the flow rate of 20000 tons/year to carry out hydrogenation, then it is treated as ethylene material, the catalyst of the above raffinate oil hydrogenation unit 3-1 is selective hydrogenation catalyst GHT-20. The volume airspeed ratio of the above raffinate oil hydrogenation unit 3-1 is 4, hydrogen/oil volume ratio is 350, the operation temperature is 325° C., the operation pressure is 2.5 MPa (absolute pressure). The above heavy petrol (distilling range 160-205° C.) enters the heavy petrol extractor 2-2 to carry out extraction separation with the flow rate of 32000 tons/year and aromatic hydrocarbon and raffinate oil are separated out. The solvent used in the above heavy petrol extractor 2-2 is N-methyl-morpholine, the extraction temperature is 115° C., the ratio of solvent (solvent/feed material) is 3.5 (mass), the rinsing ratio of the raffinate oil is 0.2 (mass), the recovered temperature of the solvent is 151° C., the recovered pressure of the solvent is 0.112 MPa (absolute pressure), the above aromatic hydrocarbon as the product of the heavy petrol abstraction is blended with the aromatic hydrocarbon as the product of the medium petrol abstraction with the flow rate of 11000 tons/year, then it enters the aromatic hydrocarbon hydrogenation unit 3-2 to carry out hydrogenation, subsequently it is mixed with the above light petrol.

The catalyst of the above aromatic hydrocarbon hydrogenation unit 3-2 is full hydrogenation catalyst GHT-22, the volume airspeed ratio of the above aromatic hydrocarbon hydrogenation unit 3-2 is 4, hydrogen/oil volume ratio is 350, the operation temperature is 325° C., the operation pressure is 2.5 MPa (absolute pressure). The raffinate oil as the product of the heavy petrol abstraction is blended with the raffinate oil as the product of the medium petrol abstraction with the flow rate of 21000 tons/year, then it is hydrogenated in the raffinate oil hydrogenation unit, finally it is extracted as fine quality ethylene material.

The distilling range of the obtained blended petrol is 30-205° C., the sulfur content is 19.35 ppm, the mercaptan content is 3.96 ppm, the olefin content is 22.46% (v), the diolefin content is 0.08% (v), the aromatic hydrocarbon content is 23.78% (v), the octane number (RON) is 93.56, the density is 712.52 kg/m3, the oil output is 59000 tons/year.

The distilling range of the obtained fine quality ethylene material is 65-160° C., the sulfur content is 0.5 ppm, the mercaptan content is less than 1 ppm, the olefin content is less than 0.1% (v), the diolefin content is less than 0.01% (v), the aromatic hydrocarbon content is 3.0% (v), the octane number (RON) is 74.34, the density is 751.60 kg/m3, the oil output is 41000 tons/year.

Embodiment 3

Figure 2:
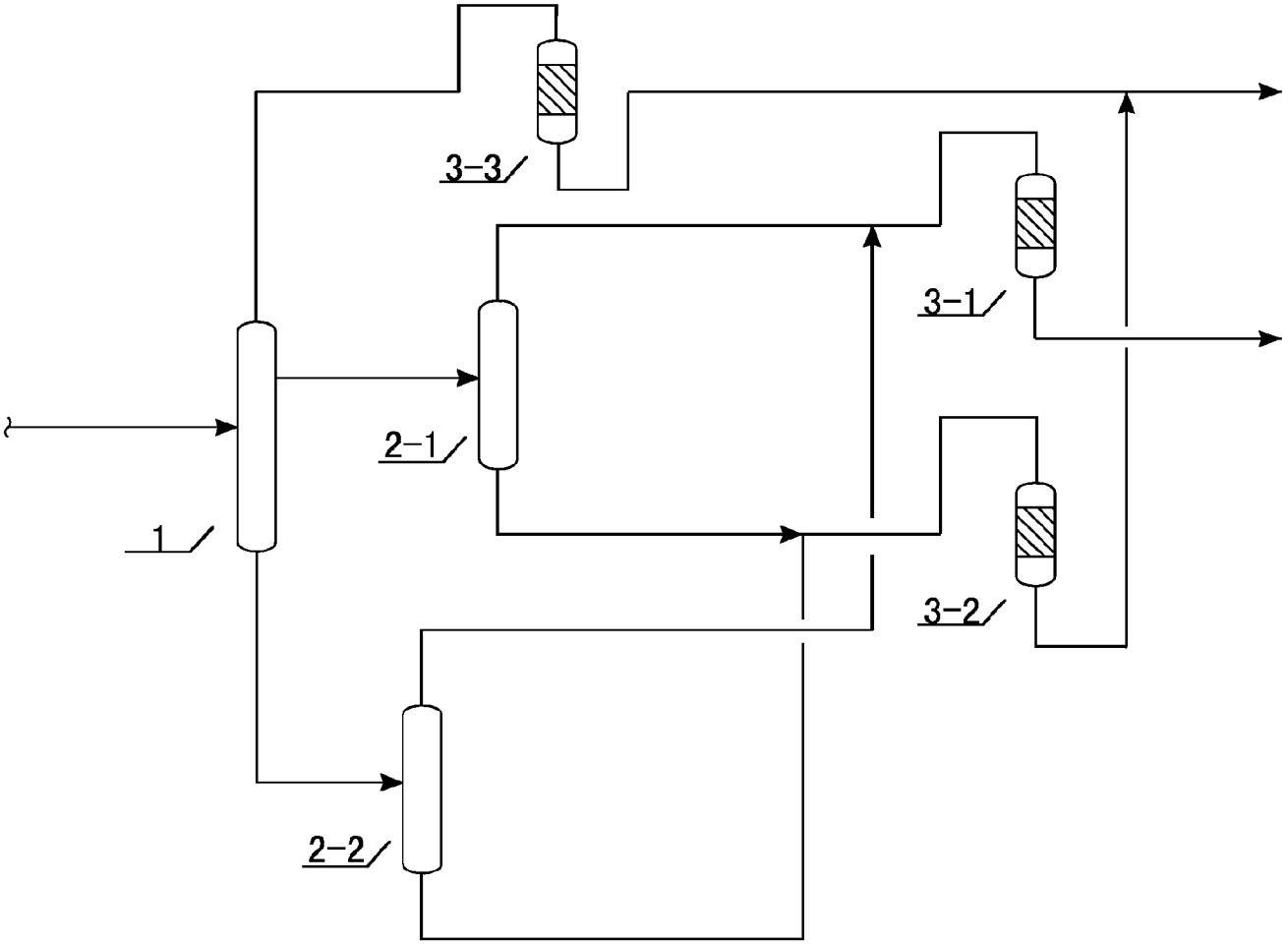
FIG. 2 is the schematic flow sheet of embodiment 3.

See FIG. 2, it is the schematic flow sheet of this embodiment. The gasoline is fractionated at fractionator 1 with the flow rate of 100,000 ton/year to the stabilized gasoline (catalytic gasoline) whose distilling range is 30-205° C., sulfur content is 2000 ppm, mercaptan content is 50 ppm, olefin content is 40% (v), diolefin content is 1% (v), aromatic hydrocarbon content is 19% (v), octane number (RON) is 91, density is 728 kg/m3, the tower top temperature of distilling tower 1 is 67° C., the tower bottom temperature is 186° C., tower top pressure is 0.2 MPa (absolute pressure), tower bottom pressure is 0.25 MPa (absolute pressure), light petrol, medium petrol and heavy petrol can be separately obtained. The above light petrol (distilling range 30-65° C.) is vaporized through the upper of distilling tower 1, the total vaporization volume is 30,000 tons/year. It is extracted after being hydrogenated in the light petrol hydrogenation unit 3-3, the catalyst of the above light petrol hydrogenation unit 3-3 is selective hydrogenation catalyst GHT-20. The volume airspeed ratio of the above light petrol hydrogenation unit 3-3 is 2, hydrogen/oil volume ratio is 150, the operation temperature is 230° C., the operation pressure is 1.0 MPa (absolute pressure). The above medium petrol (distilling range 65-160° C.) is conveyed into the medium petrol extractor 2-1 with the flow rate of 30,000 tons/year to carry out extraction separation and separate into aromatic hydrocarbon and raffinate oil. The solvent used in the above medium petrol extractor 2-1 is N-methyl-morpholine, the extracting temperature is 95° C., solvent ratio (solvent/inlet material) is 2.5 (mass), the rinsing ratio of the raffinate oil is 0.2 (mass), the solvent recovery temperature is 155° C., the solvent recovery pressure is 0.13 MPa (absolute pressure), the aromatic hydrocarbon as the product of the extraction of the above medium petrol passes the pipeline with the flow rate of 7000 tons/year into the aromatic hydrocarbon hydrogenation unit 3-2 to carry out hydrogenation, then it passes the pipeline to be blended with the hydrogenated light petrol in the upper part of the distilling tower 1. The catalyst of the above aromatic hydrocarbon hydrogenation unit 3-2 is selective hydrogenation catalyst GHT-20. The volume airspeed ratio of the above aromatic hydrocarbon hydrogenation unit 3-2 is 2, hydrogen/oil volume ratio is 250, the operation temperature is 285° C., the operation pressure is 1.5 MPa (absolute pressure). The above raffinate oil as the product of the extraction of the above medium petrol passes the raffinate oil hydrogenation unit 3-1 with the flow rate of 23000 tons/year to carry out hydrogenation, and then it is treated as ethylene material, the catalyst of the above raffinate oil hydrogenation unit 3-1 is selective hydrogenation catalyst GHT-20. The volume airspeed ratio of the above raffinate oil hydrogenation unit 3-1 is 2, hydrogen/oil volume ratio is 250, the operation temperature is 285° C., the operation pressure is 1.5 MPa (absolute pressure). The above heavy petrol (distilling range 160-205° C.) enters the heavy petrol extractor 2-2 to carry out extraction separation with the flow rate of 40000 tons/year and aromatic hydrocarbon and raffinate oil are separated out. The solvent used in the above heavy petrol extractor 2-2 is N-methyl-morpholine, the extraction temperature is 115° C., the ratio of solvent (solvent/feed material) is 3.5 (mass), the rinsing ratio of the raffinate oil is 0.2 (mass), the recovered temperature of the solvent is 151° C., the recovered pressure of the solvent is 0.112 MPa (absolute pressure), the above aromatic hydrocarbon as the product of the heavy petrol abstraction is blended with the aromatic hydrocarbon as the product of the medium petrol abstraction with the flow rate of 10000 tons/year, then it enters the aromatic hydrocarbon hydrogenation unit 3-2 to carry out hydrogenation, subsequently it is mixed with the above light petrol. The catalyst of the above aromatic hydrocarbon hydrogenation unit 3-2 is selective hydrogenation catalyst GHT-20. The volume airspeed ratio of the above aromatic hydrocarbon hydrogenation unit 3-2 is 2, hydrogen/oil volume ratio is 250, the operation temperature is 285° C., the operation pressure is 1.5 MPa (absolute pressure). The raffinate oil as the product of the heavy petrol abstraction is blended with the raffinate oil as the product of the medium petrol abstraction with the flow rate of 30000 tons/year, then it is hydrogenated in the raffinate oil hydrogenation unit, finally it is extracted as fine quality ethylene material.

The distilling range of the obtained blended petrol is 30-205° C., the sulfur content is 33.6 ppm, the mercaptan content is less than 1 ppm, the olefin content is 15% (v), the diolefin content is 0.01% (v), the aromatic hydrocarbon content is 37.4% (v), the octane number (RON) is 95.6, the density is 695 kg/m3, the oil output is 47000 tons/year.

The distilling range of the obtained fine quality ethylene material is 65-205° C., the sulfur content is 5.0 ppm, the mercaptan content is less than 1 ppm, the olefin content is 1.0% (v), the diolefin content is less than 0.01% (v), the aromatic hydrocarbon content is 4.0% (v), the octane number (RON) is 77.6, the density is 760.0 kg/m$^3$, the oil output is 53000 tons/year. The physical and chemical characteristics of the above selective hydrogenation catalyst GHT-20 are See the following table:

| Name of the index | Unit | GHT-20 |
|---|---|---|
| Appearance | | Grey three-leaf type |
| Specification | mm | Φ1.7 |
| Intensity | N/cm | 170 |
| Bulk density | g/ml | 0.70 |
| Specific surface | m$^2$/g | 180 |
| Pore volume | ml/g | 0.55 |
| $WO_3$ | m % | 6.6 |
| NiO | m % | 2.1 |
| $C_0O$ | m % | 0.16 |

The physical and chemical characteristics of the above full hydrogenation catalyst GHT-22 are See the following table:

| Name of the index | Unit | GHT-22 |
|---|---|---|
| Appearance | | Grey three-leaf type |
| Specification | mm | Φ1.7 |
| Intensity | N/cm | 180 |
| Bulk density | g/ml | 0.73 |
| Specific surface | m$^2$/g | 180 |
| Pore volume | ml/g | 0.57 |
| $WO_3$ | m % | 15 |
| NiO | m % | 1.7 |
| $C_0O$ | m % | 0.15 |
| $Na_2O$ | m % | <0.09 |
| $Fe_2O_3$ | m % | <0.06 |
| $SiO_2$ | m % | <0.60 |
| Carrier | m % | 82.4 |

The measuring methods used in this invention are as follows (same below):

1. Distilling range: GB/T6536-1997 petroleum products—determination of distillation
2. Sulfur content: SH/T0689-2000 light hydrocarbon & engine fuel and other petroleum products-determination of total sulfur content (ultra-luminescence method)
3. Mercaptan sulfur: GB/T1792-1988 Distillate fuels—Determination of mercaptan sulphur—Potentiometric titration method
4. Olefin: GB/T11132-2002 Liquid petroleum products—Determination of hydrocarbon types-Fluorescent indicator absorption method
5. Aromatic hydrocarbon: GB/T11132-2002 Liquid petroleum products—Determination of hydrocarbon types-Fluorescent indicator absorption method
6. Octane number: GB/T5487 gasoline-testing methods for octane number-research method
7. Density: GB/T1884-2000, method for laboratory measurement of crude oil and liquid petroleum products (densitometer method)
8. Measurement of the diolefin: titration method
9. Hydrogenation catalyst analysis method:

| Chemical component | Analytical procedure | Applied petrochemical industry standard |
|---|---|---|
| NiO | Colorimetric analysis | SH/T0346-1992 |
| CoO | Colorimetric analysis | SH/T0345-1992 |
| $WO_3$ | Colorimetric analysis | |
| Physical characteristics | Analytical procedure | Applied instrument |
| Surface area | Low temperature nitrogen adsorption | 2400 model sorption analyzer |
| Pore volume | Mercury intrusion method | Auto Pore II 9200 |
| Intensity | Cold Crushing Strength measurement method | DL II type intelligent granular intensity measuring gauge |
| Bulk density | Weighing method | |

Embodiment 4

Figure 3:
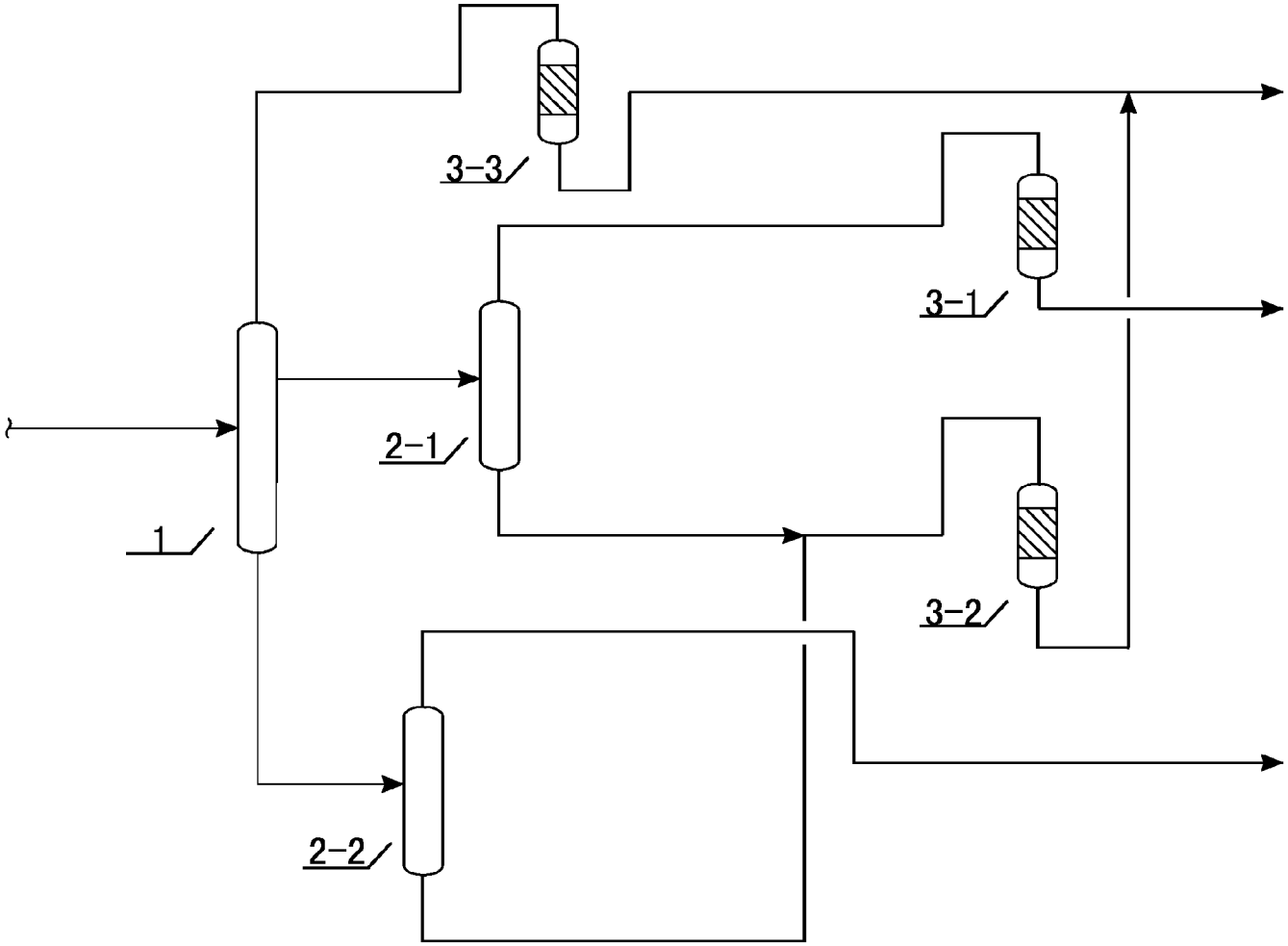
FIG. 3 is the schematic flow sheet of embodiment 4.

See FIG. 3, it is the schematic flow sheet of this embodiment.

The gasoline is fractionated at fractionator 1 with the flow rate of 100,000 ton/year to the stabilized gasoline (catalytic gasoline) whose distilling range is 30-205° C., sulfur content is 600 ppm, mercaptan content is 20 ppm, olefin content is 30% (v), diolefin content is 0.5% (v), aromatic hydrocarbon content is 13% (v), octane number (RON) is 87, density is 722 kg/m$^3$, the tower top temperature of distilling tower 1 is 67° C., the tower bottom temperature is 186° C., tower top pressure is 0.2 MPa (absolute pressure), tower bottom pressure is 0.25 MPa (absolute pressure), light petrol, medium petrol and heavy petrol can be separately obtained. The above light petrol (distilling range 30-65° C.) is vaporized through the upper of distilling tower 1, the total vaporization volume is 30,000 tons/year. It is extracted after being hydrogenated in the light petrol hydrogenation unit 3-3, the catalyst of the above light petrol hydrogenation unit 3-3 is selective hydrogenation catalyst GHT-20. The volume airspeed ratio of the above light petrol hydrogenation unit 3-3 is 2, hydrogen/oil volume ratio is 150, the operation temperature is 230° C., the operation pressure is 1.0 MPa (absolute pressure). The above medium petrol (distilling range 65-160° C.) is conveyed into the medium petrol extractor 2-1 with the flow rate of 30,000 tons/year to carry out extraction separation and separate into aromatic hydrocarbon and raffinate oil. The solvent used in the above medium petrol extractor 2-1 is N-methyl-morpholine, the extracting temperature is 95° C., solvent ratio (solvent/inlet material) is 2.5 (mass), the rinsing ratio of the raffinate oil is 0.2 (mass), the solvent recovery temperature is 155° C., the solvent recovery pressure is 0.13 MPa (absolute pressure), the aromatic hydrocarbon as the product of the extraction of the above medium petrol passes the pipeline with the flow rate of 7000 tons/year into the aromatic hydrocarbon hydrogenation unit 3-2 to carry out hydrogenation, then it passes the pipeline to be blended with the hydrogenated light petrol in the upper part of the distilling tower 1. The catalyst of the above aromatic hydrocarbon hydrogenation unit 3-2 is selective hydrogenation catalyst GHT-20. The volume airspeed ratio of the above aromatic hydrocarbon hydrogenation unit 3-2 is 3, hydrogen/oil volume ratio is 300, the operation temperature is 305° C., the operation pressure is 2.0 MPa (absolute pressure). The above raffinate oil as the product of the extraction of the above medium petrol passes the raffinate oil hydrogenation unit 3-1 with the flow rate of 23000 tons/year to carry out hydrogenation, then it is treated as ethylene material. The catalyst of the above raffinate oil hydrogenation unit 3-1 is selective hydrogenation catalyst GHT-20. The volume airspeed ratio of the above raffinate oil hydrogenation unit 3-1 is 3, hydrogen/oil volume ratio is 300, the operation temperature is 305° C., the operation pressure is 2.0 MPa (absolute pressure). The above heavy petrol (distilling range 160-205° C.) enters the heavy petrol extractor 2-2 to carry out extraction separation with the flow rate of 40000 tons/year and aromatic hydrocarbon and raffinate oil are separated out. The solvent used in the above heavy petrol extractor 2-2 is N-methyl-morpholine, the extraction temperature is 115° C., the ratio of solvent (solvent/feed material) is 3.5 (mass), the rinsing ratio of the raffinate oil is 0.2 (mass), the recovered temperature of the solvent is 151° C., the recovered pressure of the solvent is 0.112 MPa (absolute pressure), the above aromatic hydrocarbon as the product of the heavy petrol abstraction is blended with the aromatic hydrocarbon as the product of the medium petrol abstraction with the flow rate of 10000 tons/year, then it enters the aromatic hydrocarbon hydrogenation unit 3-2 to carry out hydrogenation, subsequently it is mixed with the above light petrol. The above raffinate oil as the product of heavy petrol extraction is directly extracted out as the low solidification point diesel with the flow rate of 30000 tons/year.

The distilling range of the obtained blended petrol is 30-205° C., the sulfur content is 10.0 ppm, the mercaptan content is less than 1 ppm, the olefin content is 10.4% (v), the diolefin content is less than 0.01% (v), the aromatic hydrocarbon content is 32.5% (v), the octane number (RON) is 94.5, the density is 664.6 kg/m$^3$, the oil output is 40000 tons/year.

The distilling range of the obtained fine quality ethylene material is 65-160° C., the sulfur content is 5.0 ppm, the mercaptan content is less than 1 ppm, the olefin content is 1.0% (v), the diolefin content is less than 0.01% (v), the aromatic hydrocarbon content is 1.0% (v), the octane number (RON) is 75.0, the density is 745.0 kg/m3, the oil output is 25000 tons/year. The distilling range of the obtained low solidification point diesel is 160-205° C., the sulfur content is 20.0 ppm, the mercaptan content is 2.0 ppm, the olefin content is 36.8% (v), the diolefin content is 0.1% (v), the aromatic hydrocarbon content is 2.0% (v), the density is 782.0 kg/m3, the oil output is 35000 tons/year.

Embodiment 5

Figure 4:
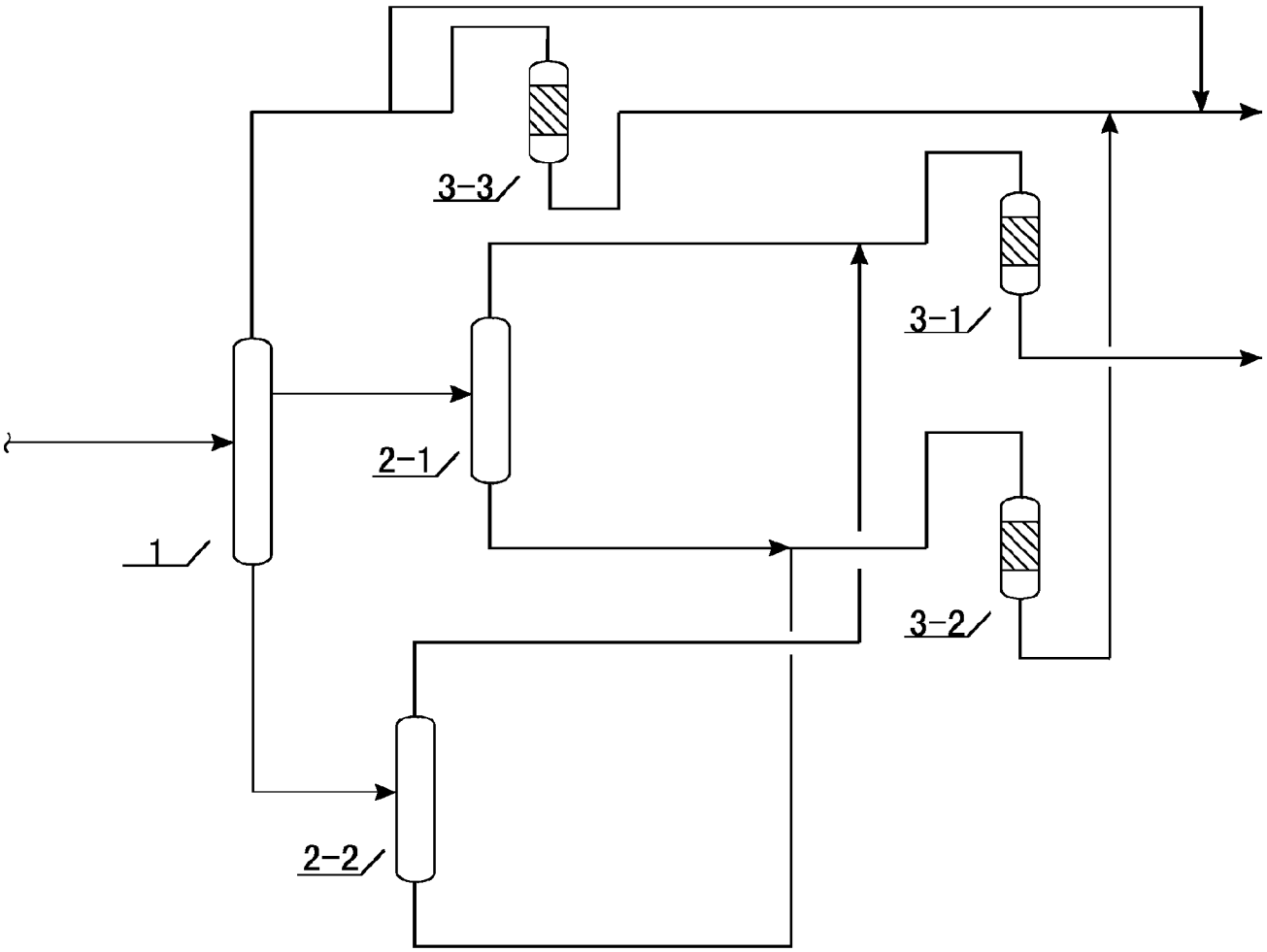
FIG. 4 is the schematic flow sheet of embodiment 5.

See FIG. 4, it is the schematic flow sheet of this embodiment. The gasoline is fractionated at fractionator 1 with the flow rate of 100,000 ton/year to the stabilized gasoline (catalytic gasoline) whose distilling range is 30-205° C., sulfur content is 100 ppm, mercaptan content is 10 ppm, olefin content is 20% (v), diolefin content is 0.8% (v), aromatic hydrocarbon content is 10% (v), octane number (RON) is 84, density is 726 kg/m$^3$, the tower top temperature of distilling tower 1 is 68° C., the tower bottom temperature is 188° C., tower top pressure is 0.11 MPa (absolute pressure), tower bottom pressure is 0.12 MPa (absolute pressure), light petrol, medium petrol and heavy petrol can be separately obtained. The above light petrol (distilling range 30-65° C.) is vaporized through the upper of distilling tower 1, the total vaporization volume is 25,000 tons/year, thereinto, 50% of the distilling volume is through the upper part of the distilling tower 1, other 50% is directly extracted. The catalyst of the above light petrol hydrogenation unit 3-3 is selective hydrogenation catalyst GHT-20, the volume airspeed ratio of the above light petrol hydrogenation unit 3-3 is 2, hydrogen/oil volume ratio is 150, the operation temperature is 230° C., the operation pressure is 1.0 MPa (absolute pressure). The above medium petrol (distilling range 65-160° C.) is conveyed into the medium petrol extractor 2-1 with the flow rate of 30,000 tons/year to carry out extraction separation and separate into aromatic hydrocarbon and raffinate oil. The solvent used in the above medium petrol extractor 2-1 is N-methyl-morpholine, the extracting temperature is 95° C., solvent ratio (solvent/inlet material) is 2.5 (mass), the rinsing ratio of the raffinate oil is 0.2 (mass), the solvent recovery temperature is 155° C., the solvent recovery pressure is 0.13 MPa (absolute pressure), the aromatic hydrocarbon as the product of the extraction of the above medium petrol passes the pipeline with the flow rate of 4000 tons/year into the aromatic hydrocarbon hydrogenation unit 3-2 to carry out hydrogenation, then it passes the pipeline to be blended with the hydrogenated light petrol in the upper part of the distilling tower 1. The catalyst of the above aromatic hydrocarbon hydrogenation unit 3-2 is selective hydrogenation catalyst GHT-20. The volume airspeed ratio of the above aromatic hydrocarbon hydrogenation unit 3-2 is 4, hydrogen/oil volume ratio is 350, the operation temperature is 325° C., the operation pressure is 2.5 MPa (absolute pressure). The above raffinate oil as the product of the extraction of the above medium petrol passes the raffinate oil hydrogenation unit 3-1 with the flow rate of 23000 tons/year to carry out hydrogenation, then it is treated as ethylene material, the catalyst of the above raffinate oil hydrogenation unit 3-1 is selective hydrogenation catalyst GHT-20. The volume airspeed ratio of the above raffinate oil hydrogenation unit 3-1 is 2, hydrogen/oil volume ratio is 250, the operation temperature is 285° C., the operation pressure is 1.5 MPa (absolute pressure). The above heavy petrol (distilling range 160-205° C.) enters the heavy petrol extractor 2-2 to carry out extraction separation with the flow rate of 45000 tons/year and aromatic hydrocarbon and raffinate oil are separated out. The solvent used in the above heavy petrol extractor 2-2 is N-methyl-morpholine, the extraction temperature is 115° C., the ratio of solvent (solvent/feed material) is 3.5 (mass), the rinsing ratio of the raffinate oil is 0.2 (mass), the recovered temperature of the solvent is 151° C., the recovered pressure of the solvent is 0.112 MPa (absolute pressure), the above aromatic hydrocarbon as the product of the heavy petrol abstraction is blended with the aromatic hydrocarbon as the product of the medium petrol abstraction with the flow rate of 10000 tons/year, then it enters the aromatic hydrocarbon hydrogenation unit 3-2 to carry out hydrogenation, subsequently it is mixed with the above light petrol. The above raffinate oil as the product of heavy petrol extraction is blended with the above raffinate oil as the product of medium petrol extraction with the flow rate of 39000 tons/year, then it undergoes raffinate oil hydrogenation treatment, finally it is extracted as fine quality ethylene material.

The distilling range of the obtained blended petrol is 30-205° C., the sulfur content is 16.4 ppm, the mercaptan content is 1.7 ppm, the olefin content is 13.7% (v), the diolefin content is 0.1% (v), the aromatic hydrocarbon content is 27.0% (v), the octane number (RON) is 91.6, the density is 664.1 kg/m$^3$, the oil output is 35000 tons/year.

The distilling range of the obtained fine quality ethylene material is 65-205° C., the sulfur content is 5.0 ppm, the mercaptan content is less than 1 ppm, the olefin content is 1.0% (v), the diolefin content is less than 0.01% (v), the aromatic hydrocarbon content is 2.0% (v), the octane number (RON) is 71.2, the density is 764.4 kg/m$^3$, the oil output is 65000 tons/year.

INDUSTRIAL APPLICABILITY

The advantage of this invention is as the following:

Compared with the existing technology, the system & method of preparing high quality gasoline through the recombination of catalytic hydrocarbon in this invention has the following advantages: first the recombination is carried out, then hydrogenation will be implemented. Therefore, the catalysts and parameters of the applied hydrogenation unit is more pertinent, the sulfur content of the blended gasoline is lower, the olefin content is further lower and the it has low cost.

We claim:

1. A system for preparing gasoline, comprising:

a fractionator;

a medium petrol extractor;

a heavy petrol extractor;

a medium petrol raffinate oil hydrogenation unit; and a medium petrol aromatic hydrocarbon hydrogenation unit;

wherein a top part outlet of the fractionator is equipped with a light petrol pipeline for discharging light petrol, a bottom part outlet of the fractionator is equipped with a heavy petrol pipeline for discharging heavy petrol, a middle part outlet of the fractionator is equipped with a medium petrol pipeline for discharging medium petrol, the medium petrol pipeline is connected with an inlet of the medium petrol extractor for transporting the medium petrol to the medium petrol extractor, the heavy petrol pipeline is connected with an inlet of the heavy petrol extractor for transporting the heavy petrol to the heavy petrol extractor, a top part outlet of the medium petrol extractor is connected with an inlet of the medium petrol raffinate oil hydrogenation unit through a pipeline for transporting a first raffinate oil from the medium petrol extractor to the medium petrol raffinate oil hydrogenation unit, a bottom part outlet of the medium petrol extractor is connected with an inlet of the medium petrol aromatic hydrocarbon hydrogenation unit through a pipeline for transporting a first aromatic hydrocarbon from the medium petrol extractor to the medium petrol aromatic hydrocarbon hydrogenation unit, an outlet of the medium petrol aromatic hydrocarbon hydrogenation unit is connected with the light petrol pipeline in the top part outlet of the fractionator through a pipeline for blending hydrogenated first aromatic hydrocarbon from the medium petrol aromatic hydrocarbon hydrogenation unit with the light petrol from fractionator, a bottom part outlet of the heavy petrol extractor is connected with the inlet of the medium petrol aromatic hydrocarbon hydrogenation unit through a pipeline for transporting a second aromatic hydrocarbon from the heavy petrol extractor to the medium petrol aromatic hydrocarbon hydrogenation unit, a top part outlet of the heavy petrol extractor is connected with the inlet of the medium petrol raffinate oil hydrogenation unit through a pipeline for transporting a second raffinate oil from the heavy petrol extractor to the medium petrol raffinate oil hydrogenation unit.

2. A system for preparing gasoline according to claim 1, further comprising a light petrol hydrogenation unit, wherein the top part outlet of the fractionator is connected with an inlet of the light petrol hydrogenation unit through the light petrol pipeline for transporting the light petrol to the light petrol hydrogenation unit, an outlet of the light petrol hydrogenation unit is connected with the outlet of the medium petrol aromatic hydrocarbon hydrogenation unit, the top part outlet of the heavy petrol extractor is connected with the inlet of the medium petrol raffinate oil hydrogenation unit through a pipeline, or the heavy petrol extractor directly produces and discharges a low solidification point diesel product.

3. A system for preparing gasoline according to claim 2, further comprising a by-pass pipeline with one end connected to the top part outlet of the fractionator and the other end connected to the outlet of the light petrol hydrogenation unit for by-passing a portion of the light petrol.

* * * * *